United States Patent [19]

Ramblier

[11] Patent Number: 4,841,758

[45] Date of Patent: Jun. 27, 1989

[54] FERROMAGNETIC BARREL LOCK AND CORRESPONDING KEY

[76] Inventor: Yves J. Ramblier, 98, rue Saint-Charles, 75015 Paris, France

[21] Appl. No.: 195,279

[22] Filed: May 18, 1988

Related U.S. Application Data

[63] Continuation of Ser. No. 49,021, May 1, 1987, abandoned, which is a continuation of Ser. No. 888,081, Jul. 14, 1986, abandoned, which is a continuation of Ser. No. 671,878, filed as PCT FR84/00035 on Feb. 21, 1984, published as WO84/03324 on Aug. 30, 1984, abandoned.

[30] Foreign Application Priority Data

Feb. 21, 1983 [FR] France ..... 83 02788

[51] Int. Cl.[4] ..... E05B 47/00

[52] U.S. Cl. ..... 70/276; 70/356; 70/365; 70/413

[58] Field of Search ..... 70/276, 356, 365, 413

[56] References Cited

U.S. PATENT DOCUMENTS

| | | | |
|---|---|---|---|
| 2,732,703 | 1/1956 | Noregaard | 70/276 X |
| 3,416,336 | 12/1968 | Felson | 70/276 |
| 3,512,382 | 5/1970 | Check et al. | 70/276 |
| 3,518,855 | 7/1970 | Kiyoyasu | 70/413 X |
| 3,552,159 | 1/1971 | Craig | 70/365 X |
| 3,584,484 | 6/1971 | Hallmann et al. | 70/413 X |
| 4,253,320 | 3/1981 | Schwab et al. | 70/276 |
| 4,476,701 | 10/1984 | Herriott | 70/276 |
| 4,631,939 | 12/1986 | Herriott | 70/413 X |

FOREIGN PATENT DOCUMENTS

| | | | |
|---|---|---|---|
| 2948068 | 4/1981 | Fed. Rep. of Germany | 70/413 |
| 2328091 | 5/1977 | France . | |
| 2378157 | 8/1978 | France . | |
| 2396145 | 3/1980 | France . | |
| 2441706 | 6/1980 | France . | |
| 2393907 | 4/1981 | France . | |
| 2477615 | 9/1981 | France . | |
| 1572091 | 7/1980 | United Kingdom | 70/276 |

*Primary Examiner*—Gary L. Smith
*Assistant Examiner*—Suzanne L. Dino
*Attorney, Agent, or Firm*—Mason, Fenwick & Lawrence

[57] ABSTRACT

Magnetic key and barrel device wherein the magnets (8) of the key (1) cooperate by repulsion with magnets (25–225) embedded into bascule elements (21–221) movable between a locking position of the lock and an operating position wherein the bascule elements release the rotor-stator interface. The rod (7) of the key (1) is configured as a tube in the wall of which are embedded the magnets (8), and the rotor is configured as a sleeve (14) in the wall of which are arranged the bascule elements (21 and 221). The sleeve (14) has in its center a cylindrical ferrous core (17) which permanently attracts the magnets (25 and 225). The stator (3) which surrounds the rotor (2) is drilled with ports (26 and 226) wherein the magnet-free bascule (21 and 221) ends are sunk. Application to any locking and control lock.

37 Claims, 7 Drawing Sheets

Figure 1:
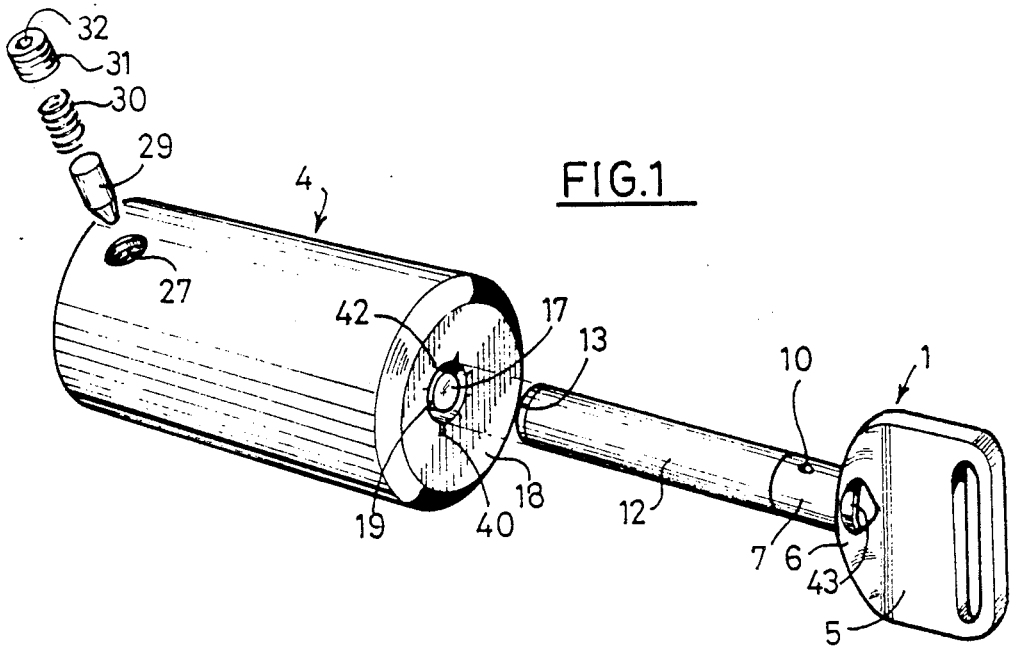

FIG.6
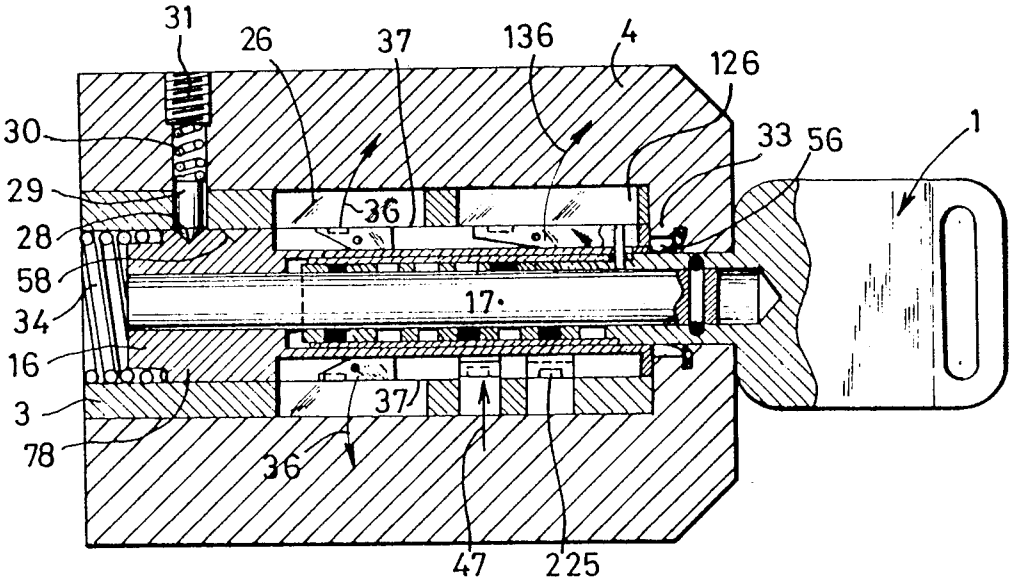
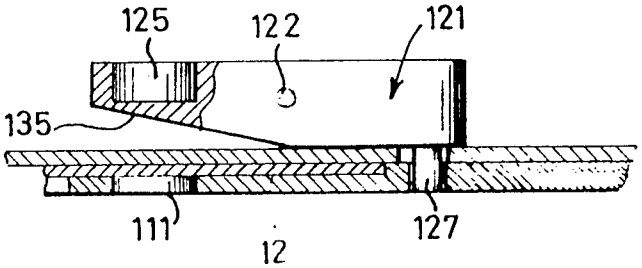
FIG.7

FERROMAGNETIC BARREL LOCK AND CORRESPONDING KEY

This application is a continuation of application Ser. No. 049,021 filed May 1, 1987, now abandoned, which was a continuation of Ser. No. 888,081 filed July 14, 1986, which was a continuation of Ser. No. 671,878 filed as PCT FR 84/00035 on Feb. 21, 1984, published as W084/03324 on Aug. 30, 1984, both now abandoned.

The present invention relates to a locking, checking, and actuating device operated by magnetic means and in particular a ferromagnetic lock of the barrel type comprising a magnetic key having a plurality of magnets which cooperate by repulsion with an equivalent number of magnets which are radially movable inside the barrel between a position for locking the lock in which they span the rotor-stator interface and prevent any movement of one of these two elements relative to the other, and a position allowing operation of said lock in which, when the key is fastened in position and the magnets of said key cooperate with the corresponding magnets of the barrel, said magnets of the barrel are fully engaged in the rotor by the effect of repulsion and thus clear the rotor-stator interface and allow, by this unlocking, the free rotation of the rotor inside the stator under the action of the fastened key.

In this operating position, the rotation of the rotor actuates, for example by means of a "lantern," all the elements and various means for shifting and locking the lock, for checking or actuating, which are disposed at the rear of the barrel while being positioned relative to its stator.

Many locking devices having a magnetic barrel and a magnetic key are known, said barrel and said key comprising an equivalent number of magnets capable of cooperating with one another in a position pertaining to a decoding of the security combination. the key being in almost all cases of a regular rectangular section and cooperating with a keyway of corresponding section provided in a cylindrical rotor a generatrix of which, or two diametrically opposed generatrices of which, are provided with cavities each adapted to receive the north end or south end of a magnet operating by repulsion with the magnet which corresponds thereto and is embedded along the edge of the key.

In such devices, the stator which surrounds the rotor is itself provided on its inner face with cavities which extend radially in the extension of each cavity of the rotor, each cavity of the stator being blind so that a spring bears against its bottom and permanently biases the magnet of the barrel toward the cavity of the rotor so that said magnet of the barrel spans the rotor-stator interface and prevents any movement of the rotor as long as the magnetic key, which has the correct decoding owing to a particular arrangement of its magnets, is not correctly placed in its position inserted in its corresponding passageway in the rotor.

In the devices of the aforementioned type, one of the large sides of the magnetic key is often provided with a recess which extends longitudinally throughout the length of the key and cooperates with a congruent rib provided longitudinally on one of the two large sides defining the passageway of the rotor so as to locate the key relative to said passageway and allow the penetration of the key in the passageway in a single position at the end of which, if the key is that which, by its arrangement of magnets, corresponds to the specific arrangement of the magnets of the barrel, there is automatically achieved the decoding of the combination and the unlocking of the rotor-stator interface under the effect of the repelling forces that the magnets of the key exert on the magnets of the barrel which exceed the thrusts exerted by the springs of the stator in the opposite direction on the magnets of the barrel.

The magnets embedded in one or in both edges of the magnetic key are of simple shape and mostly cylindrical and of very small height.

The magnets of the barrel on the other hand are longer, since they must move between their locking position in which they span the rotor-stator interface and their unlocking position in which they are fully engaged in the cavities of the stator: their great length enables them to effect these to and fro movements without the risk that some of these magnets gradually assume a transverse position relative to their natural sliding position and consequently without the risk that these magnets become definitively immobilized in a position in which they span the rotor-stator interface or in a position in which they are fully engaged in the stator in which respective positions they would render any unlocking impossible or would adversely affect the quality of the locking.

The magnets of the barrel are therefore most often cylinders having a height of a few millimeters and sometimes having the shape of a diabolo and made from tungsten so as to improve the sliding motion and considerably increase the shear strength.

Such devices are for example disclosed in French Pat. Nos. 81 04649/2477615, 78 22971/2396145, and various improvements in magnetic keys which may be used in such devices are for example disclosed in French Pat. Nos. 76 31055/2328091, 78 01786/2378157 and 79 28016/2441706.

However, all these devices have the same drawbacks.

First, they require specialized manufacturing equipment and labour and, owing to the small size of the magnets and the return springs and the high precision required for placing them in position, the work is most exacting and can only be carried out correctly a few hours per day.

Secondly, the North-South magnets of each magnetic key the number and position of which are chosen by the constructor and and/or by the client, are necessarily powerful magnets since they must overcome, by repulsion, the thrusts exerted by the springs at the rear of each magnet of the barrel until the magnets are urged back into their cavities of the stator and completely clear the rotor-stator interface.

The fact that the magnets of the key are powerful has therefore a first drawback of picking up filings (which, in the course of the lock opening and closing operations, are liable to alter the barrel) and of being easily detectable, in position and polarity, by a third party who has the coded magnetic key in his possession and who could reproduce this key right away without much difficulty, since the shape and the design of the key are after all simple.

Thirdly, the prescribed arrangement in such devices for combining the magnetized codes of the barrel and of the key cannot in any way allow the barrel to be made from hardened ferrous metals, otherwise some of the magnetized codes would be modified and would render the shifting of the barrel impossible.

The fact that the barrel cannot be made from a hardened ferrous metal has the obvious drawback that the barrel is rendered weak as concerns drilling and chiselling and consequently little resistant to breaking-in attempts on the part of burglars.

Fourthly, all the devices just referred to employ a key which is rendered rigid with the barrel and which ensures the mechanical driving of the rotor by the very effect of its shape which is of a regular and therefore simple rectangular section.

Even when the key is thin, it necessarily has a minimum thickness slightly greater than the diameter of the magnets to be embedded in its edges, so that the entrance of the passageway or the rotor, or more simply the "keyhole", has a rectangular shape and a corresponding section. Now, it results from investigations carried out by the police and insurance companies that this shape incites ill-intentioned persons to fill the keyhole with bits of paper or bits of matches and even encourages a breaking of the lock. Filling the keyhole with wood or paper obviously prevents the full insertion of the key and consequently renders the shifting of the barrel impossible. As concerns the breaking of the lock, it is relatively easy, since it is sufficient to insert a strong screwdriver in the keyhole and rotate it and in this way break the magnets which span the interface and then actuate the lock almost as easily as with the coded key.

In order to overcome some of the aforementioned drawbacks, it has been proposed to employ locking devices employing a magnetic barrel and magnetic key in which the key is cylindrical and solid and the barrel is surrounded by a steel sleeve. In this new type of construction, all the magnets of the barrel are permanently naturally attracted in the outward direction by the sleeve. The height of the magnets of the barrel is then, by construction, greater than the depth of the cavities of the stator, so that, in this position of natural attraction of the magnets of the barrel by the steel sleeve, said magnets span the rotor-stator interface and thus prevent any rotation or insertion of the rotor inside the stator.

The corresponding magnets of the key are embedded on the periphery of the latter in number and position appropriate to the decoding of the magnets of the barrel, and more precisely to their radial displacement by attraction, so that the magnets of the barrel advance inside the cavities of the rotor until they are completely engaged therein and clear the rotor-stator interface.

Such devices of this second type are for example disclosed in French Pat. No. 77 18108/2,393,907.

In this construction, the magnets of the key are of course very powerful since they must exert on the magnets of the barrel an attraction which exceeds the attraction exerted permanently by the sleeve surrounding the stator.

However, the fact that the magnets of this type of key are powerful does not constitute the same drawback as that concerning the key of rectangular section which is, it will be recalled, easily reproducible, since the cylindrical shape given to the new key allows an arrangement of magnets along 4, 6 or 8 generatrices and not along two lines. Consequently there is a greater difficulty in locating the magnets the number of which is notably greater and the position of which is always chosen arbitrarily among the possible locations the number of which is obviously greater than those which may be provided along the two edges of an ordinary key of rectangular section.

This new locking device also avoids the difficulties mentioned before as concerns the specialized manufacturing equipment and labour and as concerns the exacting nature of the work involved in positioning the springs biasing the magnets of the barrel toward the rotor so as to constitute a kind of "keying action" in the region of the rotor-stator interface.

In the new devices having a steel sleeve, there is indeed no necessity to provide springs since the magnets of the barrel are placed in the "keying" position by the natural permanent attraction exerted by said sleeve on said magnets of the barrel which places them in a position in which they span the rotor-stator interface.

On the other hand, the third and fourth drawbacks encountered in the devices of the first type are still present in the devices of the second type, that is to say:

(a) The rotor and the stator of the devices of the second type are of necessity made from a non-magnetic metal, usually brass, and therefore from a metal which is weak as concerns drilling and chiselling and which, in practice, affords no particular defense against lock-breaking attempts.

(b) The key of these second devices has a shape which is also simple to reproduce, whence the confirmed possibility of breaking the lock by forcing the rotor to rotate by means of a tool of the same shape as that of the key associated with a powerful actuating wheel, this being moveover facilitated by the fact that the key has at its end a groove which cooperates with a lug projecting from the inner end of the rotor, inside the passageway, which lug is provided originally for positioning the key inside the passageway and driving the rotor in rotation after penetration of the keying magnets in the rotor, but which, in the event of an attempt to break the lock, will unfortunately act as a support for the tool employed.

An object of the present invention is to overcome all of the foregoing drawbacks, both as concerns devices of the first generation and as concerns those of the second generation. Thus, the combination of the magnetic key and the magnetic barrel proposed by the present invention:

(a) requires no small spring for exerting thrusts at the rear of the magnets of the barrel and placing them in their "keying position";

(b) proposes potentially several tens of possible positions of magnets at the periphery of the key, so that this key cannot be reproduced; the total impossibility of reproducing the key of the invention is moreover doubly guaranteed by the fact that it has a shape which is much more complicated and more difficult to machine than the solid cylindrical key of the devices of the second generation;

(c) permits the association with the barrel of a central ferrous core which protects the lock against any attempt to drill the lock;

(d) displays a keyhole which is so small and of such discouraging shape that it overcomes the temptation to fill the keyhole and break the passageway of the rotor of the barrel.

The narrowness of the passageway just mentioned at (d) moreover has the additional advantage of affording the possibility of protecting the keyhole of the lock by a diaphragm and/or by a sealing O-ring, the diaphragm protecting the lock from weather and from all harmful atmospheres and consequently allowing its use in the field of the automobile and navigation where the vehicles or craft are considerably exposed to rain, frost and the sea, and the sealing O-ring cleaning the key each time it is inserted into the lock, which prolongs as much as possible the life of the locks equipped in this way.

The present invention therefore provides a locking, checking and actuating device actuated by magnetic means, and in particular a ferromagnetic lock, comprising a magnetic key having one or more magnets which cooperate by attraction and/or repulsion with an equivalent number of magnets which are transversely movable inside a barrel between a position in which they span the rotor-stator interface and prevent any movement of the rotor relative to the stator, and a position in which, when the key is fastened in position and the magnets of the key cooperate with the magnets of the barrel which correspond thereto, said magnets of the barrel are fully engaged, for example by attraction in the rotor or repulsion in the stator, until they clear said interface and thus allow the free rotation of the rotor inside the stator, under the action of the key fastened in position, said rotation of the rotor actuating the locking, checking or actuating means which are disposed at the rear of the barrel and are positioned relative to said stator, said device being characteized in that the stem of the key is in the form of a cylindrical tube in the wall of which tube are embedded the magnets of the key, the rotor is in the form of a cylindrical sleeve in the wall of which sleeve are placed longitudinal and/or transverse tumblers each mounted to be pivotable about a pin disposed substantially in the middle of said tumblers, each tumbler comprising a magnet which cooperates by repulsion with a magnet of the key, said rotor comprising in its centre a cylindrical ferrous core which extends longitudinally along the same axis as the sleeve throughout the length of said sleeve, said core being spaced from the wall of said sleeve a distance slightly greater than the thickness of the stem of the key, said rotor further comprising means for fastening the key in position and means for unlocking the key, said stator which surrounds the rotor being provided with at least one longitudinal and/or transverse opening in which th end of the tumbler devoid of a magnet is inserted so long as the corresponding magnet of the key does not act by repulsion on the magnet of the tumbler to the extent of overcoming the permanent force of attraction that the central ferrous core exerts on said magnet of the tumbler.

In this construction, the tumblers having a magnet which ensure the "keying" of the rotor to the stator are naturally maintained in this keying position owing to the fact that they are attracted toward the ferrous core which constitutes the center of the rotor and the centre of the lock.

Thus it is clear that the device of the invention employs no spring of small size for applying the "keys" of the barrel in their position in which they span the rotor-stator interface and lock the lock..

Further, the disposition of the ferrous core at the centre of the lock constitutes an inviolable defense as concerns screwdrivers, chisels and drills that burglars might be tempted to employ.

This defense against attempts to break the lock is all the more inviolable as the possible access to the tools of the burglars available between the central core of the rotor and the sleeve of the rotor, even the outer side of the body of the cylinder which may clad and protect the barrel in its adaptation to the point to be protected, for example a door, is a circular annular space whose radial extent is very small since it is substantially equal to the radial thickness of the key stem.

The annular passageway or chamber defined between the sleeve and the central core of the rotor is devoid of any projection.

In other words, even if the burglars had a tool having a hollow cylindrical rod capable of penetrating said chamber, they could not force the rotor to rotate since their tool would freely rotate.

In a preferred embodiment, each longitudinal tumbler has a parallel-sided shape and is disposed in a cavity formed in the longitudinal wall of the sleeve of the rotor, this tumbler being mounted to pivot about an axis which extends in a direction perpendicular to the longitudinal axis of the sleeve and parallel to the bottom of the cavity, between the two longitudinal edges of the cavity, the lower side of the half of the parallel-sided tumbler which comprises the magnet being chamfered in the longitudinal direction from the middle to the end of the tumbler half concerned.

Likewise, each transverse tumbler is in the form of a cylindrical sector disposed in a cavity formed in the longitudinal wall of the sleeve of the rotor, said tumbler being mounted to pivot about an axis which extends in a direction parallel to the longitudinal axis of the sleeve, the lower side of the half of the cylindrical sector which comprises the magnet being chamfered from the middle to the end of the tumbler half concerned.

By means of simple constructions, having a parallel-sided shape for each longitudinal tumbler and the shape of a sector of a cylinder for each transverse tumbler, the provision of a bevel on the lower side of each tumbler below the cavity containing the embedded magnet enables said tumbler, when its magnet is attracted by the ferrous core of the rotor, to pivot about its axis so that the bevelled part bears against the bottom of the cavity provided for receiving said tumbler while the part the most remote from the bevel, namely the upper surface of the side opposed to the magnet, projects from the cavity and is inserted in the corresponding opening of the stator and thus constitutes a key which prevents any displacement of the rotor relative to the stator then, when its magnet is repelled by the magnet corresponding thereto on the magnetic key, the tumbler pivots about its axis and bears against the bottom of its cavity by its lower side, in its half devoid of a magnet, while its upper side is placed parallel to said bottom and therefore parallel to the rotor-stator interface in a withdrawn position relative to said interface which enables the rotor to rotate and/or penetrate in the stator.

In a first modification of the fastening of the magnetic key to the rotor of the barrel, the fastening means are mechanical and, for example, the stem of the key comprises near to the base of its ear a tooth which extends radially outwardly and is cooperative with a recess formed in the wall of the sleeve of the rotor.

Thus, when viewed from the exterior, the keyway of the lock has the shape of a very thin circular ring to the exterior of which is connected a slot for the passage of the tooth projecting from the key stem, the width and the height of the slot also being as small as possible.

In a second modification of the fastening of the magnetic key to the rotor of the barrel, the fastening means are magnetic. Advantageously, the wall of the cylindrical tube constituting the key stem is provided with at least one transverse, preferably blind, orifice and at least one pivotal tumbler of the rotor is provided with a radial pin which extends from the lower side of the tumbler toward the central core of the rotor in the half of said tumbler devoid of a magnet, said pin extending through the sleeve of the rotor throughout its thickness from the bottom of the cavity in which the tumbler is pivotally mounted and projecting to a great extent in the annular chamber of the rotor between the longitudinal wall of the sleeve and its central ferrous core, so that said pin cooperates with the orifice of the key and drives the rotor whenever the key is shifted.

In this manner of fastening the key, at least one of the tumblers of the rotor therefore performs a double function: (a) so long as the key is not inserted in the lock and the magnetic combination is not decoded, the tumbler performs a function of a key in the region of the rotor-stator interface, since its magnetized half, attracted by the central ferrous core is engaged in the cavity while its other half projects into the openings of the stator; (b), then, when the key is inserted in the barrel in order to decode the magnetic combination, the magnetized half of the tumbler is urged toward the rotor-stator interface and the other half, which was previously engaged in an opening of the stator, retracts behind the interface, in which case the tumbler ceases to act as a key and its function is replaced by a new key-fastening function by the cooperation of its radial pin with the orifice formed in the key stem.

With the key fastened to the rotor of the barrel by one or more tumblers, the rotation and/or insertion of the key in the lock drives the rotor relative to the stator in the same motion, since at the same time all the other tumblers which have only the single function of a key between the rotor and the stator are completely retracted into their respective cavities after decoding upon the rotation and/or decoding upon the insertion.

It should be mentioned here that the association of the magnetic key and barrel of the present invention appears to be the first to propose a magnetic fastening of the key.

The keys of the devices of the first generation indeed drive the rotor by their very shape, which is usually rectangular, and the keys of the devices of the second generation drive their rotor by mechanical means, by cooperation of a pin provided in the bottom of the passageway of the rotor with a slot provided at the free end of the key.

In another advantageous embodiment, the front part of the central core extends beyond the front end of the sleeve of the rotor and is flush with the outer surface of the body of the cylinder.

The protection of the lock is thus still further considerably improved, since the projecting parts of the barrel, namely the front wall of the body of the cylinder and the end of the central core of the rotor which projects from the sleeve are exceptionally consequent and render any access to the keying tumblers impossible from the exterior as concerns both drills and chisels. The prescribed use of hardened steel for the core and the body of the cylinder will moreover prevent the drills and chisels from getting a hold on such elements.

According to a preferred embodiment, the part of the stem of the key in which the magnets are embedded is covered with a protective stainless steel sheath which is adhered and/or set in position at the end of said key.

The interest of such a sheath is double: it prevents the magnets from falling out and it provides the key from any fraudulent analysis for the purpose of its reproduction by a third party.

In this construction, each magnet of the key is advantageously placed within the thickness of the wall of the stem inside a radially oriented cup.

According to another preferred embodiment, the front end of the central core of the rotor includes a transverse groove which receives an O-ring, the base of the ear of the key being then provided with at least one orifice which opens onto the inner end of the cylindrical tube constituting the key stem.

The engagement of this key stem in the keyway of annular shape causes the O-ring to repel any impurities which might soil the inner surface of the key stem, from the free edge of this stem toward the inner end thereof.

When the key is thereafter engaged throughout its length in the annular chamber of the rotor defined between the sleeve and the central core, the possible impurities present within the key stem are automatically extracted by passing through the discharge orifices provided at the base of the ear of the key.

For its application in boating, aviation, and the automobile, and generally in any field where the lock is considerably exposed to the weather, rain, snow, frost or sea water, for example, the annular chamber defined between the sleeve and the central core of the rotor is closed in its front part by a diaphragm of rubber which is rigid with the barrel and surrounds the ferrous core so as to render the lock fluidtight, this diaphragm being capable of retracting upon the passage of the key.

It is quite clear that such a diaphragm not only seals the lock from liquids but also prevents any entry of dust, grains, gravel, and any other solid material in suspension in the air.

Incidentally, it should be noted that the magnetic key and barrel combination of the invention is the first which enables a lock to be rendered completely fluidtight; indeed, only the shape of the key stem, which has a regular circular section, in addition to the fact that it is devoid of any projection in the case of a magnetic fastening of the key to the rotor of the barrel, permits the interposition of a sealing diaphragm which is capable of completely closing the keyway of the lock with no risk of tearing when the key stem is inserted.

In its most simplified construction, the locking device according to the invention is actuated by keys all of which have a single reference position of abutment for example preferably formed by the base of the ear of the key.

In an improved construction, the locking device according to the invention is actuated by a key having a double reference abutment position, a position termed "ordinary" determined by the inner end of the cylindrical tube of the key which bears against the front end of the core of the rotor, and a position termed "confidential" determined by the base of the ear of the key which is rearwardly offset relative to the base of the ear of the key having a single reference abutment position, the passage from the "ordinary" position to the "confidential" position being achieved by an increased pressure upon the insertion of the key in the lock so as to urge back the rotor by overcoming the force exerted by the return spring disposed behind said rotor, against the inner end of the sleeve, so as to cause said rotor to assume a second reference position as concerns penetration which can only be decoded by the key having a double reference abutment position. Thus, at the moment of locking the magnetic barrel, any owner of a key having a double reference position can choose the way in which he will unlock it; if he exerts no pressure when inserting the key in the lock, the rotor remains in its same position of insertion in the stator so that any other owner of a key having a double reference position or a key having a single reference position would be able to unlock the barrel; on the other hand, if he locks the barrel after having urged the rotor rearwardly of the stator, and therefore after having exerted a pressure upon the insertion of his key, so that it was urged inwardly while shifting the rotor the same distance from its "ordinary" position to its "confidential" position, only the holders of a key having a double reference position would be able to act on the barrel in the unlocking movement thereof, after having decoded the multiple tumblers spanning the rotor-stator interface. On the other hand, the holders of keys having a single reference position will not be able to decode all said tumblers so that there will remain at least one keying in the region of the rotor-stator interface which will render the unlocking movement impossible.

In another construction, the stator is advantageously provided with a plurality of openings which are cooperative with one or more longitudinal or transverse tumblers of the rotor and which define n positions of selection in rotation of the rotor, also preferably arranged on the periphery of the stator, in which the rotor is locked relative to the stator while allowing the unlocking of the key. In this embodiment, the front side (sleeve or core) of the rotor and/or the front side of the stator and/or the front side of the body of the cylinder are provided with visual means for locating the position in which the rotor is selected as concerns rotation relative to the stator, and consequently visual means for locating the position in which the key must be engaged in the lock so as to be immediately fastened to the rotor and simultaneously ensure the decoding in rotation and, as the case may be, the decoding in penetration, of all of the tumblers.

In its improved construction having at least two reference positions, the locking device of the invention is advantageously such that its stator is provided with a plurality of openings which are cooperative with one or more tumblers of the rotor and which define n positions of selection of the rotor, at least two of which positions are at simultaneously different extents of penetration and rotation.

The device of the invention therefore may be locked or may check or actuate from a plurality of positions which may be located in rotation; further, in its embodiment having at least two reference positions, the device of the invention will have at two different extents of penetration locking, checking and actuating positions which, in the case of some, will only be accessible to a holder of a key having multiple reference positions and, for others, will be accessible to these holders and also to those who possess the suitable magnetic key having a single reference position.

In another improved form of construction, the rotor of the barrel of the device of the invention comprises at least one shoe selecting one of two, namely forward or reverse, directions of rotation of the rotor in the stator, said shoe being constructed in the form of a tumbler of parallel-sided type whose magnet is disposed for example in the rear part, the front upper face of the shoe having a small face which is inclined both forwardly and from the periphery toward the centre of the rotor, said small face extending substantially on the upper front right or left half of the shoe; in this case, the magnetic key is either of the type permitting the selection in rotation, in which case it has magnets in the required number and position for repelling all the tumblers and shoes of the rotor, or of the type permitting only one of two rotations of the rotor, in which case it does not have a magnet in the region of the magnet of the shoe. In this construction, a holder of a key permitting the selection in rotation will be able to lock and unlock the magnetic barrel; on the other hand, the holder of a key devoid of a magnet in the region of the magnet of the shoe will only be able to effect a single rotational shifting of the rotor. For example, the shifting will be in the forward direction, in the case where the small face is formed on the right half of the shoe. This shifting will enable the holder to lock the device. However, shifting in the opposite direction to unlock the device will always be impossible for him. Conversely, he may be able to unlock the device but prohibited from locking it.

In the embodiment of the device having a plurality of reference positions, the rotor of the barrel comprises at least one shoe arranged in the manner of a tumbler of the parallel-sided type whose magnet is disposed necessarily in the rear part, the front upper face of the shoe having two small faces which are inclined both forwardly and in the direction from the periphery toward the centre of the rotor, said small faces each extending substantially in a front upper respectively right and left half of the shoe; in this construction, the stator has an opening exclusively for receiving the front half of the shoe, which was pivoted when the rotor was shifted rearwardly of the stator by a stronger pressure of penetration of the key in the lock, so that it leaves its "ordinary" position and assumes its "confidential" position, while the key having a double reference position does not possess a magnet in the region of the magnet of the shoe so that said magnet is permanently naturally attracted by the ferrous central core and automatically moves to the position for keying the rotor in the stator. Owing to this construction, the holder of a key having a double reference position will be able to lock the magnetic barrel in a position in which the rotor is depressed relative to the stator, in which at least some of the codes of the tumblers in the keying position will not be able to be decoded upon the engagement of a key having a single reference position.

Thus, only the holder of this key having a double reference position, or of another exactly identical key, will be able to decode all the magnetic combinations.

It will then be easy for him to shift the rotor in a forward or reverse direction of rotation, since as all the other tumblers of the barrel are then retracted, the shoe henceforth constituting the sole retaining means will in turn be retracted by a progressive sliding of its small face concerned by such a rotation under the stator.

The thrust exerted by the return spring disposed at the rear of the rotor will then automatically return the latter to its most advanced position relative to the stator.

The means for unlocking the magnetic key when the rotor is in the desired position, are formed by a ball or pin which extends through the stator and is permanently urged toward the rotor, beyond the rotor-stator interface, by resiliently yieldable means, said ball or pin cooperating with at least one recess formed at the rear on the outer surface of the cylindrical sleeve of the rotor.

Advantageously, the cylindrical sleeve of the rotor then has in its rear part, on its periphery, a plurality of recesses disposed in a transverse ring arrangement and evenly spaced apart in accordance with the longitudinal or transverse openings and tumblers which are respectively provided in the stator and rotor and define n selecting positions in rotation of the rotor.

Thus the rotor is locked in the stator in one of the n positions in rotation specifically selected by the holder of the key.

In the more improved form of construction having a double reference position, the rotor has a plurality of recesses at least two of which are at different distances away from the front face of the rotor, said two recesses acting as references for the locking of the rotor by means of the key having a double reference position, one being for the "ordinary" position and the other for the "confidential" position. Thus irrespective of the position chosen by the holder of the key having a double reference position from the two positions, namely the depressed or the non-depressed position of the rotor in the stator, it will always be easy for him to know very precisely that or those of the positions in which he can lock the barrel, since this or these positions will be noticeable by mere sensitivity, depending on whether the ball or pin permanently resiliently urged toward the rotor, cooperate with a recess provided for this purpose in correspondence with the desired locking position or positions.

Figure 3:
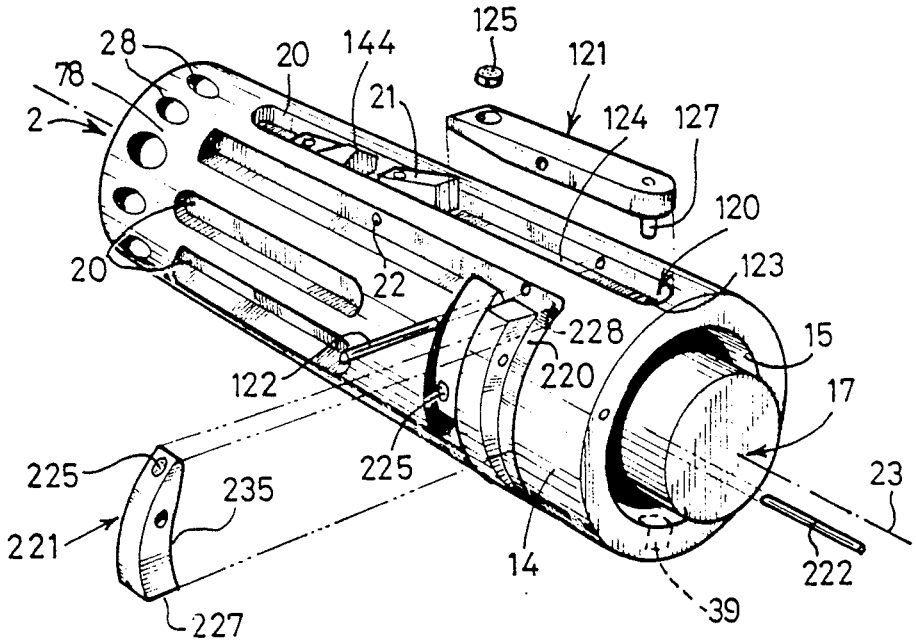
Figure 2:
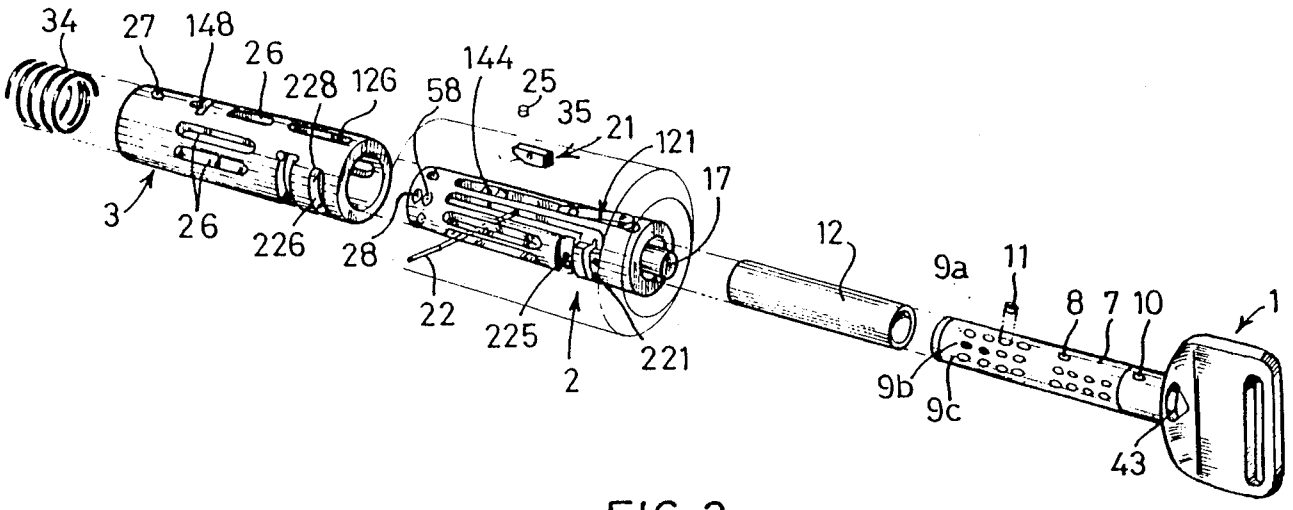
Figure 4:
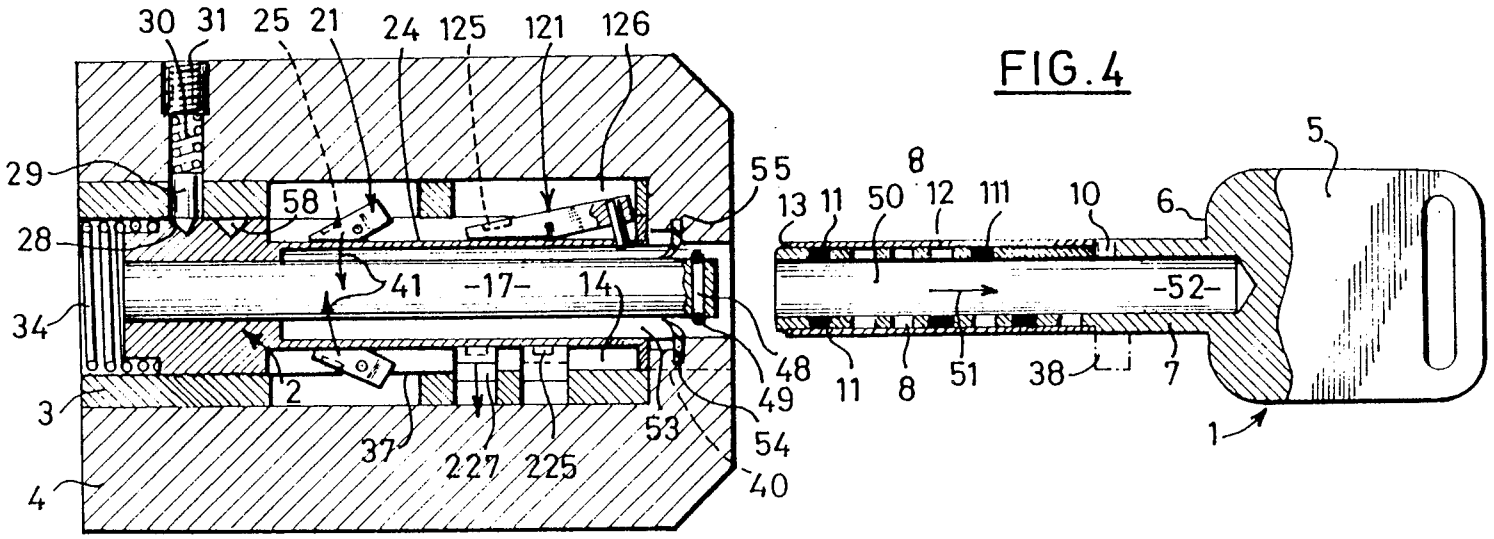
Figure 5:
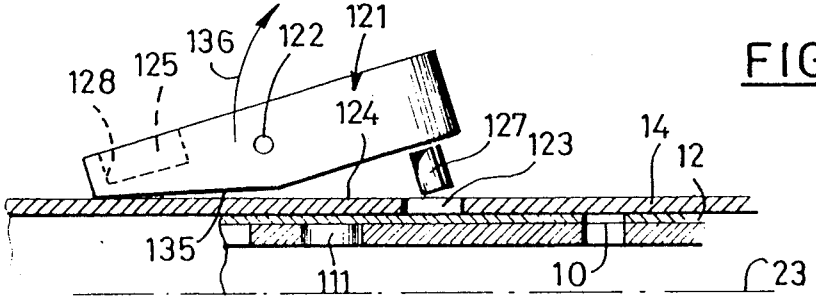
Figure 9:
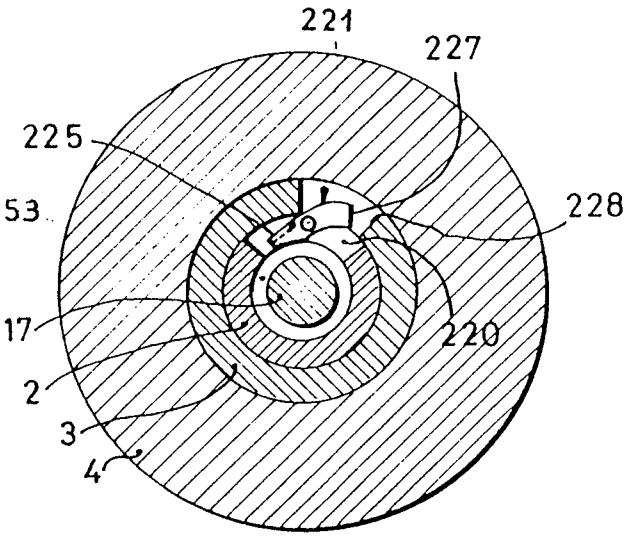
Figure 8:
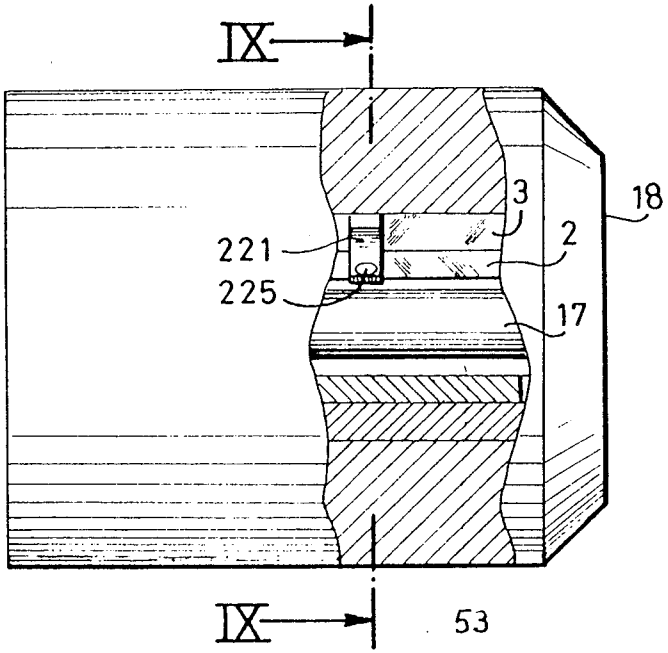
Figure 10:
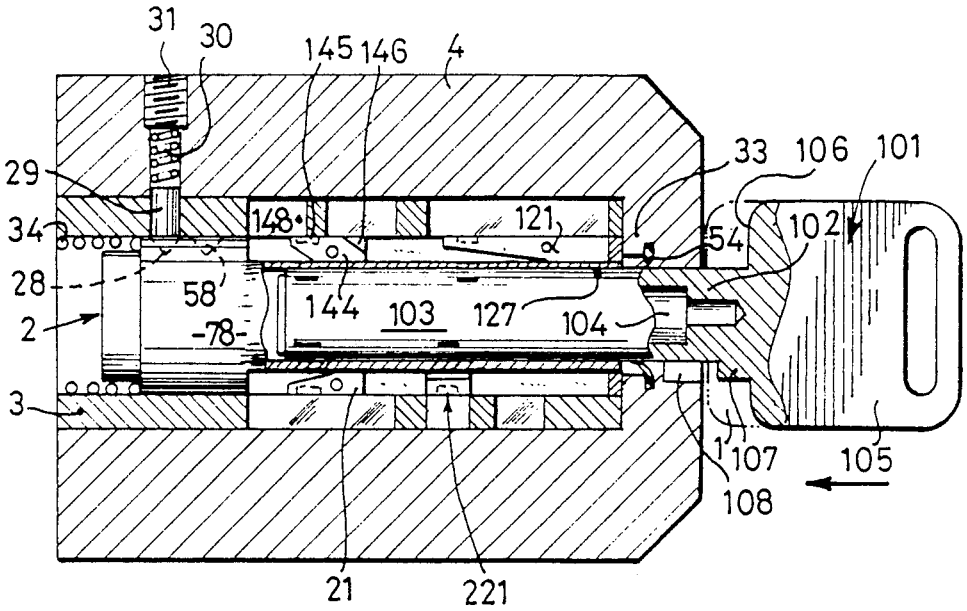
Figure 11:
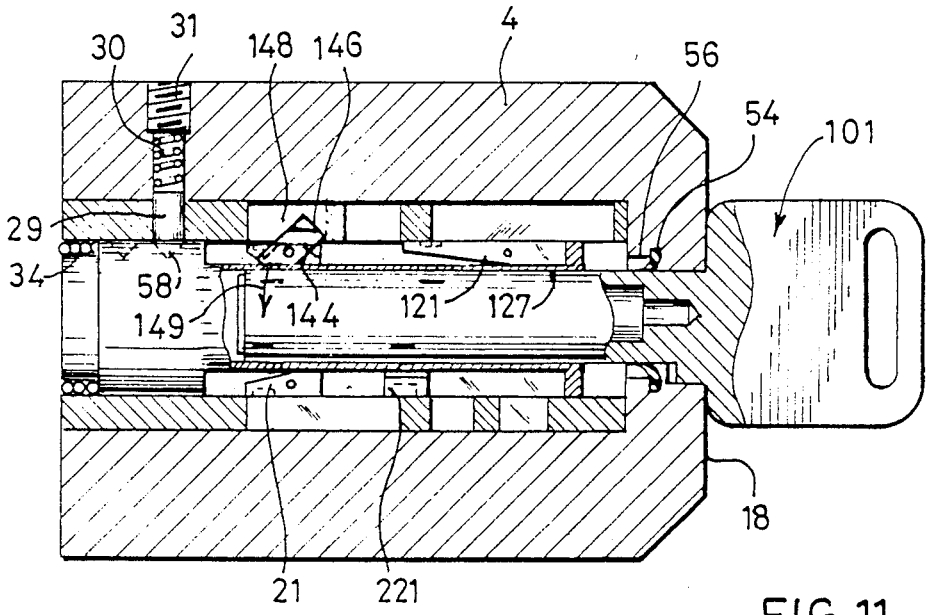
Figure 12:
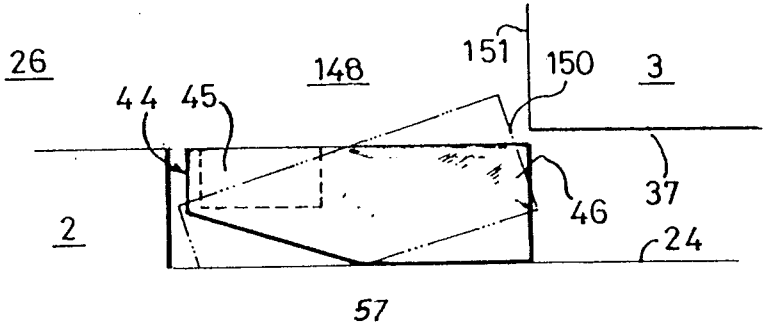
Figure 13:
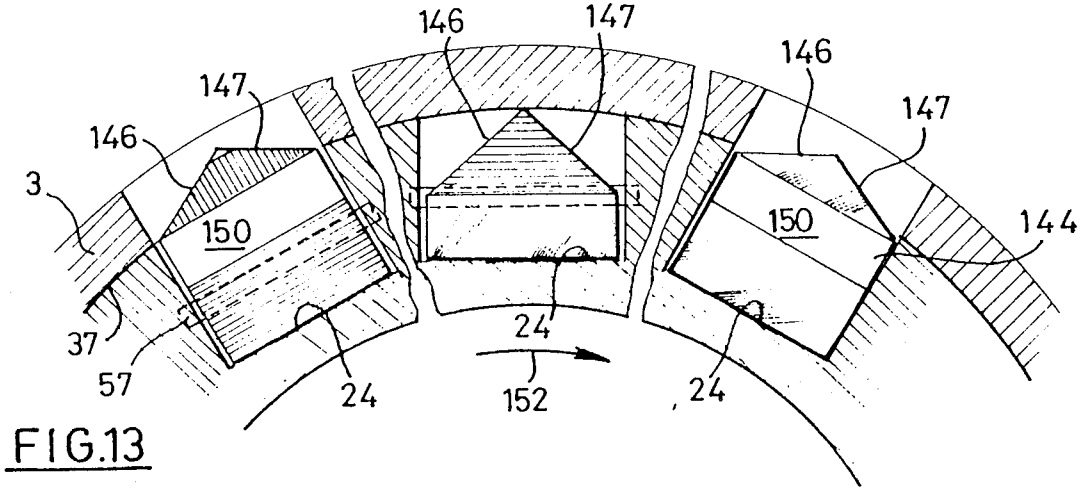

In order that a better understanding of the subject matter of the present invention be had, there will now be described hereinafter, merely by way of non-limiting illustrations, various embodiments of the invention with reference to the accompanying drawings in which:

FIG. 1 is a perspective view of the magnetic key of the locking device of the invention and of the body of the cylinder which may be employed for cladding the corresponding magnetic barrel, this body showing the specific configuration of the keyhole of circular annular shape, FIG. 2 is an exploded perspective view of all the components of the locking device of the invention, FIG. 3 is a perspective view, to an enlarged scale, of the rotor of the barrel in the wall of which are pivotally mounted longitudinal and transverse tumblers, FIG. 4 is a longitudinal axial sectional view of the device of FIG. 1 shown in one of its locking positions before the engagement of the key, FIG. 5 is a detail view of the special tumbler for fastening the key to the rotor, said tumbler being shown in its position for keying the rotor to the stator, FIG. 6 is a longitudinal axial sectional view of the device of FIG. 4, shown in its unlocking position after the engagement of the key and the decoding of all the tumblers upon penetration and rotation of the key, FIG. 7 is a view of the tumbler of FIG. 5 in its position for fastening the key to the rotor, after repulsion of its magnet by the corresponding magnet embedded in the stem of the key, FIG. 8 is a side elevational view, with a part cut away, of the device of FIG. 1, showing in detail the keying by means of a tumbler in the shape of a sector of a cylinder which may be used for locking the barrel upon penetration and possibly rotation of the key, FIG. 9 is a sectional view taken on line IX—IX of the device of FIG. 8, showing the keying of the rotor to the stator by means of the tumbler in the shape of a sector of a cylinder, FIG. 10 is a longitudinal axial sectional view of the device of FIG. 4, cooperating with a magnetic key having a double reference position, FIG. 11 is a view of the device of FIG. 10 in which the rotor has been shifted rearwardly relative to the stator by insertion of the key having a double reference position to such position that the rotor can be locked to the stator, for example by means of the shoe having small faces of FIG. 12, and FIG. 13 illustrates how the shoe of FIG. 12 is retracted under the stator in the course of the rotation of the rotor.

With reference to the drawings, it can be seen that the reference numeral 1 generally designates the magnetic key of the locking, checking and actuating device of the invention which cooperates with a barrel comprising a rotor 2 and a stator 3 which are for example protected by a body 4 of cylindrical shape.

The key 1 comprises an ear 5 at the base 6 of which is connected a stem 7 formed by a cylindrical tube whose thickness is of the order of a millimetre.

The wall of this key stem is provided with cylindrical cups 8 which have a depth of about 0.5 mm and a diameter of about 2 mm, said cups being advantageously arranged in eight rows 9*a*, 9*b*, 9*c*, . . . 9*h*, each row having eight cups except the row 9*a* which has only five cups 8 disposed adjacent to the free end of the stem 7. The stem 7 is provided, in alignment with this row 9*a*, with a radial preferably blind orifice 10 whose function will be to permit the magnetic fastening of the key to the rotor.

Some of the cups 8, chosen by the manufacturer and/or the holder of the key 1, receive a magnet 11 of cylindrical shape and having dimensions equal to those of the cups and oriented North-South in the thickness of the stem.

The magnets 11, numbering about four to twenty depending on the quantity and complexity of the locking, checking and actuating operations that the user of the device of the invention desires to possess, are each adhered to the bottom of their cup 8.

Further, a cylindrical sheath 12 covers the stem 7 of the key, at least in the part thereof in which the cups 8 are formed, so as to protect the few magnets 11 embedded in some of the sixty-one cups to prevent these magnets from falling out and also to protect the key from any fraudulent analysis that a third party might be tempted to effect for the purpose of unlawfully reproducing the key 1 with its specific arrangement of magnets as concerns position and quantity chosen by the manufacturer or user.

The sheath 12 is adhered, and preferably set at 13, at the end of the stem 7.

In order to provide a good protection, the sheath 12 is preferably of stainless steel, the slight magnetism of this material hindering in no way the transmission of the magnetism of the magnets 11 of the key 1 to the corresponding magnets of the barrel.

The magnetic barrel comprising the rotor 2 and the stator 3 is described in detail as concerns its construction and operation, with reference to FIGS. 2 to 7.

The rotor 2 is arranged in the form of a cylindrical sleeve 14 which is open at 15 in its front part and closed in its rear part by an inner end wall 16 from the centre of which extends a cylindrical core 17 inside the sleeve and coaxial with the latter throughout the length of the sleeve, this core being spaced from the wall of the sleeve a distance slightly greater than the thickness of the wall of the stem 7 of the key 1.

Owing to the particular shape of the sleeve 14 and the central core 17 in this sleeve, the shape of the opening 15 which constitutes the keyhole is a circular ring which is congruent to the section of the stem of the key covered with its sheath 12. It is clear that this shape should discourage any attempts to break the lock, since no tool is capable of getting a hold on anything in the region of and at the rear of the entrance 15, especially as the annular cylindrical chamber defined between the sleeve 14 and the core 17 of the rotor 2 is itself devoid of any projection on which the lock-breaking tool could bear.

As concerns the engagement of the key 1, this lack of projections is in fact an advantage, since the key can be inserted in any position without danger of breaking one of the component parts of the barrel or key.

The central core 17 advantageously extends beyond the front end of the sleeve 14 of the rotor, as can be clearly seen in FIGS. 2 and 3, so as to be flush with the outer face 18 of the cylindrical body 14 in the particular case where the latter clads the barrel 2–3.

In this case, the visible part 19 of the keyway is also a circular ring as shown in FIG. 1, capable of discouraging any lock-breaking attempt. Further, the core 17 and the cylindrical body 4 are of hardened steel so that they cannot be attacked by drilling or chiselling.

Various cavities are formed in the lateral wall of the sleeve 14.

In its simplest arrangement, in whch the magnetic keybarrel combination is coded solely in respect of rotation, said cavities are formed longitudinally in alignment with the rows 9 of cups 8 some of which are coded with the magnets 11.

Some of the longitudinal cavities 20 receives a longitudinal tumbler 21 which has a parallel-sided shape and is mounted to pivot about a pin 22 which extends in a direction perpendicular to the longitudinal axis 23 of the sleeve 14 and parallel to the bottom 24 of the cavity.

Each longitudinal tumbler 21 comprises a magnet 25 which is cooperative with one of the elements 11 embedded in the stem of the key 1.

In this respect, it will be clear that the tumblers 21 are placed in longitudinal cavities 20 in a number and position which are respectively a function of the number and position chosen for the magnets 11.

Corresponding to the longitudinal blind cavities 20 of the rotor 2 are longitudinal openings 26 on the stator 3, between the edges of which openings are engageable the tumblers 21 in their pivotal motion.

In the example of the magnetic key 1 having eight rows of cups, the wall of the stator is provided with eight longitudinal openings 26 and the wall of the sleeve 14 of the rotor 2 is also provided with eight cavities extending longitudinally.

In order to locate the eight ideal positions of the rotor in its rotation inside the stator, in each of which positions the openings 26 are exactly in alignment with the cavities 20, the stator 3, and possibly the cylindrical body 4, is provided with an orifice 27 which opens out in confronting relation to the rear part of the rotor, in the region of the lantern element 78, in front of a ring of eight recesses 28 disposed in a common plane perpendicular to the axis 23. The orifice 27 receives a ball or pin 29, a spring 30 and a screw 31 which can be rotated by its head 32 so that it is possible to adjust the force with which the ball or pin is resiliently biased toward the lantern of the rotor.

Consequently, there will correspond to each cooperation of the ball or pin 29 with a recess 28 the desired alignment of the eight openings 26 of the stator 3 with the eight longitudinal cavities 20 of the rotor 2.

The rotor 2 is prevented from moving in translation inside the stator 3 and, in the particular example in which the barrel is clad with the cylindrical body 4, the rotor 2 bears by its end against an element fixed to the body 4, or at any rate is biased toward the end 33 of the body 4, by a spring 34 which permanently strongly urges the rotor against the end 33 of the body 4 so as to ensure the exact longitudinal positioning of the rotor inside the stator in which the longitudinal tumblers 21 can pivot and engage between the longitudinal walls of the openings 26, which positioning is furthermore easily located by the cooperation of the ball or pin 29 with the transverse ring of recesses 28.

In this relative position of insertion of the rotor in the stator, it is clear that, when the rotor reaches, in rotating, one of the eight positions selected by the cooperation of the pin 29 and a recess 28, all the tumblers 21 pivot about their substantially median pivot pin 22 under the effect of the permanent force of attraction that the ferrous central core 7 exerts on the magnet 25 of all of said tumblers. In order to allow the pivoting by magnetic attraction of the various longitudinal tumblers, each of the tumblers is so shaped that the lower face of the half of the parallel-sided tumbler which includes the magnet 25 is bevelled in the longitudinal direction, i.e. chamfered at 35 from its middle to the end of said half of the concerned tumbler.

In their common pivotal position, each of the various longitudinal tumblers 21 engages in an opening 26 by their end devoid of a magnet. Thus, as in other magnetic locks of the prior art, the movable elements, namely the pivotal tumblers 21, span the interface between the rotor 2 and the stator 3 and prevent any rotation of the rotor relative to the stator (FIG. 4).

Upon the engagement of the magnetic key 1, and under the express condition that there correspond to each magnet 25 of a tumbler 21 on the stem 7 of the key 1 a magnet 11, which moreover has a repelling effect on the magnet 25, the permanent force of attraction exerted by the ferrous core 17 on each tumbler magnet 25 is overcome by the force of repulsion exerted by the corresponding magnet 11 of the key 1, so that all the tumblers 21 pivot about their pivot pin 22, as shown in FIG. 6 by the arrows 36, until they clear the interface 37 defined between the rotor 2 and the stator 3. The rotor is then free to rotate inside the stator.

In order to do so, means must be provided for fastening the key 1 to the rotor 2, on one hand to ensure that any rotation of the key correspond to the same rotation of the rotor in the stator, and on the other hand to ensure that the key always maintain its position relative to the rotor in its driving motion and permanently maintain the tumblers 21 in their retracted position relative to the interface 37.

Two fastening arrangements are possible, namely a mechanical fastening and a magnetic fastening.

The means for providing a mechanical fastening of the key to the rotor for example comprise a tooth 38 which extends radially outwardly from the stem 7 of the key (FIG. 4) close to the base 6 of its ear 5, said tooth cooperating with a cavity 39 formed in the front end face of the sleeve 14 of the rotor (FIG. 3).

In the case where the barrel is cladded with its cylindrical body 4, the wall 18 of the latter is split at 40 throughout the thickness of its end 33 to permit the passage of the tooth 38 (FIGS. 1 and 4).

This arrangement has however the drawback of allowing access to the rotor from the exterior of the cylindrical body and moreover preventing a perfect sealing against dust in suspension and liquids of the interior of the magnetic barrel, as will be described hereinafter.

Therefore, whenever possible there will be preferred to the mechanical fastening a magnetic fastening employing a specific tumbler whose operation is illustrated in detail in FIGS. 5 and 7.

The fastening tumbler 121 is arranged in a manner identical to the longitudinal tumblers 21. Thus it has a parallel-sided shape and is mounted to pivot about a pivot pin 122 disposed substantially in the middle of the tumbler between the longitudinal sides of a longitudinal cavity 120 formed in the lateral wall of the sleeve 14 at the front end and in alignment with the row 9*a* limited to five cups 8. The fastening tumbler 121 is substantially longer than the ordinary keying tumblers 21. Said tumbler 121 has, in addition to a magnet 125 embedded at the rear of the tumbler 121 inside a cup 128 formed in the upper face of the parallel-sided tumbler, a radial pin 127 which extends from the lower face of the tumbler toward the core 17 in the half of the tumbler devoid of a magnet.

Before insertion of the magnetic key 1, the fastening tumbler 121 is attracted in its rear half provided with the magnet 125 toward the core 17 and consequently in order to allow this pivoting, the tumbler 121 is chamfered at 135 throughout its rear half in the same way as the tumblers 21 are chamfered at 35. In its position of permanent attraction by the core 17 (FIG. 5), the tumbler 121 is inserted by its front part between the longitudinal walls of an opening 126 so that it also constitutes a keying arrangement in spanning the interface 37. In this position of attraction, the pin 127 is flush with, and in any case does not extend through, an orifice 123 extending throughout the thickness of the sleeve 14 from the bottom 124 of the cavity 120 in which the tumbler 121 is pivotally mounted.

Corresponding to the magnet 125 of the fastening tumbler 121 is a magnet 111 embedded in the cup of the row 9*a* located the closest to the base 6 of the ear 5 of the key 1. Consequently, upon the engagement of this key in its position corresponding to the decoding in rotation of the barrel, the magnet 111 places itself under the magnet 125 of the tumbler and produces the inverse pivoting 136 of said tumbler, since the force of repulsion is then greater than the force of attraction exerted by the central core 17. At the end of this pivoting 136 after repulsion, the pin 127 has passed through the orifice 123 and is engaged in the radial orifice 10 disposed on the stem of the key close to the base of the ear so as to form the magnetic fastening of the key to the rotor. In its fastened position, the tumbler 121 has cleared the interface 37 so that it is no longer an obstacle to the rotation of the rotor inside the stator when it is driven by means of the key 1 (FIG. 6).

The key can therefore be rotated through a complete turn, in which case the rotor actuated by its lantern, through means which are not shown since they are conventional in any lock, elements which will themselves actuate, check or more simply lock or unlock a door. After this rotation through one turn, the key will be unlocked by a simple traction after having ascertained, by a slight sensitivity to the rotation, that the pin 29 cooperates with its recess 28. Indeed, in this position, it is ensured that, at the instant of withdrawing the key 1, all the tumblers 21 and 121 will be able to pivot under the effect of the force of attraction exerted by the core 17 on all the magnets 25 and 125, as diagrammatically shown in FIG. 4 by the arrows 41, since, in this position of selection in rotation of the rotor relative to the stator, the halves of the tumblers devoid of a magnet will be able to enter the openings 26 and 126 and will thus perform their keying function by spanning the interface 37.

In a first form of application, the magnetic locking device described hereinbefore could also be employed in all or certain of the seven other positions allowed by the arrangement of the rotor, the stator and the key, in accordance with eight similar rows. These positions of selection in rotation could be located by visual means such as grooves 42 formed in the front face 18 of the body of the cylinder 4, or in the front face of the core 17, or in the face of the stator should the latter be visible from the exterior in some constructions.

In some of these positions selected in rotation, operations other than conventional locking and unlocking operations could be performed.

For example, in its application to automobile locks, in which moreover the keys could be shorter by using eight rows of cups of only four apertures allowing consequently thirty-two possible magnet codings in the case of a mechanical fastening and twenty-nine possible magnet codings in the case of a magnetic fastening, it will be possible by means of the eight positions preselected on the key and on the rotor to put the starter key in the road position, the parking position, the position for exclusively opening the luggage compartment or the fuel tank cap.

In another embodiment employing the tumbler termed "shoe" shown in FIG. 12, it will be possible to limit the rotational operations to a single one of the two directions, namely the forward or reverse direction for the holders of keys in which are embedded all the magnets required for magnetically decoding the barrel except one.

In this application, the shoe 44 is arranged in the manner of a tumbler 21 of the parallel-sided type whose magnet 45 is disposed for example in the rear part, the front upper face of the shoe 44 having furthermore a small face 46 which is inclined both forwardly and from the periphery toward the centre of the rotor 2, said small face extending substantially on the right or left front upper half of the shoe, the disposition chosen for the small face being a function of that of the two rotational operations desired to be selected. The principal key associated with such a device will comprise all the magnets 11 required for decoding in rotation all the tumblers 21, 121 and the shoe 44. On the other hand, the accessory key associated with such a device will comprise all the magnets required for the decoding in rotation of the tumblers 21 and 121 but will not include the magnet required for decoding the shoe 44. Thus, the holder of an accessory key will be able to fasten his key to the rotor and simultaneously retract all the keying tumblers from the rotor-stator interface, in which case he will be able to rotate the rotor to the side on which the small face 46 is located, this small face being progressively retracted under the stator as the rotation continues owing to its very shape, but he will never be able to rotate the rotor to the other side since, owing to the absence of a small face, the shoe in its keying position has no means whereby it can be automatically retracted under the stator.

In other words, the holder of an accessory key will be able to rotate solely for closing without ever being able to open, or, on the contrary, will be able to rotate for opening without ever being able to rotate for closing. This particular arrangement has its application in the supervision of certain buildings and in the maintenance of certain apparatus when, for reasons of security, it is necessary to prevent repairers from having access to certain parts of these apparatus. The holder of any principal key, however, will be able to effect the two rotations of the aforementioned device, since by the very presence of the additional magnet repelling the magnet 45 of the shoe, the latter will be in any case retracted under the interface 37 and be consequently incapable of preventing one of the forward and reverse directions of rotation.

In another embodiment allowing the rotation of the assembly comprising the rotor and the key fastened to the rotor, through $\frac{1}{8}$th of a turn, $\frac{1}{4}$ of a turn, $\frac{1}{2}$ of a turn or one turn, followed in each case by the possibility of withdrawing the key from the barrel, the longitudinal tumblers cooperating for their keying purposes with longitudinal openings are replaced by transverse tumblers cooperating with transverse openings.

In this other embodiment shown in the drawings, the lateral wall of the sleeve 14 has transverse blind cavities 220 in at least certain of which is disposed a transverse tumbler 221 constructed in the shape of a cylindrical sector mounted to pivot about a pin 222 disposed substantially in the middle of the tumbler 221, said pin extending in a direction parallel to the longitudinal axis 23 of the barrel. Each tumbler is provided on its upper face with a cup in which there is embedded a magnet 225 which cooperates by repulsion with the magnet of the key which corresponds thereto. The lower face of the half of the cylindrical sector which includes the magnet 225 is bevelled, i.e. chamfered, at 235 from substantially its middle to the end of said half provided with the magnet.

The stator 3 is provided with openings 226 which extend transversely over a length of the order of $\frac{3}{8}$ to one half of the circumference of the stator.

The transverse tumblers 221 cooperate with the magnetic key 1 and key the rotor to the stator in the same way as the longitudinal tumblers.

Thus, before insertion of the key, the transverse tumblers ae subjected exclusively to the action of the magnetic core 17 which attracts all the magnets 225 toward the core and thus pivots the magnetized half of each tumbler 221 toward the core 17 and causes all the transverse tumblers to span the rotor-stator interface, each by its unmagnetized half. The front wall 227 will then abut against a small side 228 of the opening 226 in the event that a rotating force is exerted on the rotor.

In this construction, it is clear that at least two of the transverse tumblers 221 must be disposed in opposite directions as concerns their magnetized half and their unmagnetized half. Indeed, in the case of the mounting of all the transverse tumblers in such manner that all the magnetized halves occupy the same relative position, said magnetized halves pivoted toward the core by the natural attraction exerted by the latter, will be retracted under the inner lateral wall of the stator in the case of a forced rotation of the rotor in the direction of said magnetized halves so that said tumblers will progressively rise up to the complete clearance of the interface and will no longer constitute an obstacle to the rotation, even if they were not decoded for this rotation.

Also, in the embodiment employing exculsively transverse tumblers for locking the barrel against rotation, at least two of these tumblers muct be mounted in opposed directions so that they constitute obstacles, by their oppositely oriented front walls, to any forced rotation in the forward or reverse direction. This construction of transverse tumblers 221 mounted in opposed directions is moreover that shown in FIGS. 2 and 3.

Upon the engagement of the key, and always under the express condition that this key has all the magnets 11 required for decoding by repulsion of the magnets 225 embedded in the various transverse tumblers in the keying position, said transverse tumblers will pivot about their pin 222 so that their magnetized half moves downwardly, as shown diagrammatically in FIG. 6 by the arrow 47, until they clear the interface 37. At the same time, the key 1 was fastened to the rotor by the cooperation between the orifice 10 and the radial pin 127 of the longitudinal tumbler 121 pertaining to the fastening. As no tumbler than constitutes an obstacle to the rotation, the key 1 can be turned through one turn so as to lock or unlock a door for example, or be turned through $\frac{1}{8}$th of a turn for assuming for example one to eight output positions for remote controls.

In an embodiment of improved performance, the system comprising longitudinal tumblers and openings is combined with the system of transverse tumblers and openings as shown in FIG. 2 to 6. In this embodiment, before decoding the magnetic combination, each longitudinal tumbler 21 and 121 and each transverse tumbler 221 indeed performs the function of a key preventing any rotation of the rotor in the stator, then, in the case of a full decoding by the appropriate magnetic key, all the longitudinal and transverse tumblers are retracted in the same movement and then allow the free rotation of the rotor and its positioning relative to the stator in that one of the eight positions chosen by the operator. In this chosen position, after withdrawal of the key, at least certain of the longitudinal and/or transverse tumblers, including in particular the fastening tumbler 121, will be placed opposite a corresponding opening 26, 126 or 226 in which the unmagnetized half of the tumbler will be engaged upon the pivoting of the latter under the attraction exerted by the magnetic core 17.

Advantageously, the system comprising transverse tumblers and openings will however be employed simultaneously for a second coding by penetration of the rotor in the stator, as will be described hereinafter.

Bearing in mind the specific shape given to the magnetic key of the device of the invention and that given to the corresponding keyway, two new advantages of the device of the invention over known devices may be stressed, namely that of the automatic cleaning of the key as it is inserted in the keyway, and that of the complete sealing of the lock.

For the purpose of automatically cleaning the key when it is inserted, the front end of the core 17 has a transverse groove 48 receiving an O-ring 49 whose outside diameter is very slightly larger than the inside diameter of the central passageway 50 of the stem 7 of the key 1. Thus, when the key is inserted in the keyway, any dirt which might soil the inner surface of the stem of the key is pushed back in the direction 51 toward the inner end 52 of the tube. As the base 6 of the ear 5 of the key is provided with at least one orifice 43 which communicates with this end 52, the dirt will be automatically discharged merely by the effect of gravity when the key 1 is fully engaged in the keyway and the O-ring 49 comes alongside the orifice 43.

In order to seal the lock, the annular chamber 53 defined between the sleeve 14 and the core 17 of the rotor 2 is closed in its front part by a rubber diaphragm 54 which is for example embedded at its base in a transverse groove 55 formed in the cylindrical body 4 in a position slightly set back from its inner end 33, this diaphragm gripping round the core 17 so as to seal completely the lock and yet remaining capable of retracting upon the passage of the key stem, as can be seen in particular in FIG. 6. For this purpose, a cavity 56 is formed in the inner end 33 of the cylindrical body 4 in front of the groove 55 for receiving the part of the diaphragm which is bent inwardly upon the insertion of the key.

The fact of ensuring such a complete seal is of particular interest in the case of an application of the device of the invention to a lock widely exposed to the weather as is the case in the fields of boating, the automobile or aviation. Note that this complete seal is however obtained only with the use of the additional original feature constituted by the magnetic fastening which has the advantage of rendering the key perfectly cylindrical, i.e. devoid of any projection such as a tooth 38 or the like.

Another advantage inherent in this perfectly cylindrical arrangement of the magnetic key 1 is that it can be inserted in any position in the keyway 19 without the slightest danger of breaking a component of the key or barrel. As long as the key is not fastened to the rotor by the entry of the pin 127 in the orifice 10, the key turns freely in the annular chamber 53. Lastly, note that the insertion of a key which is unsuitable for decoding the lock does not constitute any more risk of damaging the lock proper, since the unsuitable key will turn freely in the chamber 53 without ever being fastened to the rotor and/or will never decode in rotation all of the magnetic combinations created by the other longitudinal and/or transverse tumblers.

Note that any magnetic combination defined by the constructor and/or the user may be rapidly modified, if need be, without involving complicated handling. A radical change in the magnetic combination consists for example in disassembling a longitudinal tumbler, reversing the position of the tumbler relative to the stator and displacing in the magnetic key the corresponding magnet 11 from the cavity from which it was able to act on the magnet 25 of said tumbler to the cavity from which it will be henceforth operative. At the choice of the user, the magnets 25 will therefore be placed in front of or at the rear of the pivot pins 22.

As has already been proposed, the system comprising transverse tumblers and openings 221–226 is employed simultaneously for a second magnetic coding by penetration of the rotor in the stator.

For this purpose, there is substituted for the first magnetic key 1 which had only a single reference position, by the base 6 of its ear 5, a key 101 having a double reference position: a position termed "ordinary" position by abutment of the blind end 102 of its cylindrical tube 103 against the front end 104 of the core 17 of the rotor, and a position termed "confidential" position achieved by the base 106 of its ear 105, which is then rearwardly offset relative to the base 6 of the ear 5 of the key 1 having a single reference position. This rearward offset is illustrated in FIG. 10 in which the magnetic key having a single reference position is shown in dot-dash lines.

In this construction, the passage from the "ordinary" position to the "confidential" position is achieved by exerting a greater pressure when inserting the key 101 in the lock so as to exert a force on the core and urge back the rotor by compressing the spring 34 placed behind the latter against the inner end of the sleeve so as to cause the rotor to adopt its second reference position as concerns penetration of the key shown in FIG. 11, in which the key 101 bears by its base 106 against the front face 18 of the cylindrical body 4.

In this second or "confidential" position which is unavailable to the holder of the key 1 having a single reference position, the holder of the key 101 can perform various operations only available to him.

Thus, after having decoded the barrel in rotation and in penetration by causing the retraction of the various tumblers 21-121-221 by having positioned his key 101 so as to employ its first or "ordinary" position by cooperation of the inner end 102 with the core 17, as could be achieved by the holder of a key 1 having a single reference abutment position by abutment against the face 18 of the base 6 of the ear 5, the holder of the key having a double reference abutment position can thereafter, in exerting a pressure when inserting the key, pass to the "confidential" position shown in FIG. 11 in which: (a) he for example brings about a locking of the lock by turning the rotor through one turn and allowing the rotor to return to its ordinary position as a result of the return movement caused by the action of the spring 34, in which case the subsequent unlocking will only be possible by the action of a holder of the key having a double reference position who will be the only one capable of effecting the reverse rotation of the rotor by bringing the latter back to its "confidential" position; in its application to a lock with a single barrel and a knob in the interior, this arrangement moreover permits the immobilization of the interior knob, which will bring about the situation in which it will be no longer possible to shift the lock depressed in this way, even from the interior, unless of course the special key 101 is employed from the exterior; (b) he brings about, by an additional rotation through $\frac{1}{8}$th of a turn, after penetration, various remote controls; (c) in the case of a Bramah key, by using a key 101 provided with a block 107 at its base, which block cooperates with an oblong slot 108 formed in the cylindrical body 4, he actuates a micro-switch the depression of which for example actuates a dating clock which will subsequently permit checkings, the use of said key 101 in its "confidential" position in which the rotor is urged inside the stator, permitting at the same time for example checking that the door is perfectly locked (application in the field of night watching and in prisons for example); (d) he permanently places the rotor in this "confidential" position which is inaccessible to holders of a key having a single reference position, by locking the rotor in its innermost position by means of a shoe whose operation has been explained with reference to FIGS. 12 and 13. The shoe 144 is of the shoe type 44 shown in FIG. 12 modified in respect of its magnet 145 which is of necessity disposed in the rear half of the shoe, i.e. at the rear of the pin 57, and in respect of its front upper face which this time has two small inclined faces 146 and 147 which are inclined both forwardly and from the periphery toward the centre of the rotor, said small faces 146 and 147 each substantially extending on a respectively right and left front upper half of the shoe 144. In alignment with this shoe, in the position in which the rotor is urged further into the stator by the pressure exerted on the key 101, which bears by its inner end 102 on the front end 104 of the core 17, until it assumes its reference abutment position by the abutment of its base 106 against the face 18 of the cylindrical body 4 (FIG. 11), the stator 3 has an opening 148 adapted to receive the front half of the shoe 144 which has pivoted outwardly. Indeed, owing to the permanent attraction exerted by the core 17 on the magnet 145, the shoe 144 pivots in the direction of arrow 149 in FIG. 11 so as to occupy the position shown in dot-dash lines in FIG. 12; this pivoted position is also that shown in the left part of FIG. 13. The key 101 does not have a magnet in the region of the magnet 145 of the shoe 144. Under these conditions, the key having a double reference position is never capable of returning the shoe to a horizontal position by the effect of repulsion, so that when said shoe has pivoted and is inserted in the opening 148, it bears by its front upper part 150 against the front transverse edge 152 of the opening 148 and it locks the rotor in its "confidential" position. In this position, the holder of an ordinary key having a single reference position cannot have access to the magnetic combination of the barrel so that he is forbidden from carrying out any actuation, checking, locking or unlocking. On the other hand, it is always possible to unlock the rotor for the holder of the key having a double reference position. Indeed, by inserting his key 101 completely in the keyway so that it immediately bears by the base of its ear 106 against the face 18 as shown in FIG. 11 and therefore occupies its "confidential" position, and by placing said key in such manner as to fasten it to the tumbler 121 by cooperation of the pin 127 with the orifice 10, all the other tumblers 21-121 and 221 are also decoded inasmuch as they were previously pivoted to their keying position, so that only the shoe 144 then retains the rotor in its confidential position. Now, as the key 101 is fastened to the rotor, this assembly can be rotated to the left or right, as shown by the arrow 152, since the shoe 144 is progressively retracted under the stator 3—as occurred for the shoe 44—since its small inclined face 147 allows this retraction. As soon as the shoe 144 is in the horizontal position shown in the central part of FIG. 13 in which it is fully retracted under the stator 3, it is sufficient to release the pressure exerted on the key 101 to cause the rotor to return to its "ordinary" position under the action of the spring 34 placed at the rear of the rotor.

The opening 148 which permits the engagement of the shoe 144 is either on the axis of the normal position of the fastening of the key to the rotor when the latter is in the "ordinary" position, or at $\pi/4$, $\pi/2$, $3\pi/4$ or $\pi$ from this normal fastening position. Preferably, the position in which the shoe 144 is engaged in the opening 148 will be at $\pi/4$ from the normal fastening position so that, after having urged the rotor further into the stator, it is sufficient to turn it through ⅛th of a turn to cause the shoe to engage in the opening 148. The arrangement comprising the two inclined small faces 146 and 147 then permits, after fastening the key 101 to the rotor, disengaging the rotor from the opening 148 by turning it slightly to the left or slightly to the right until the shoe 144 is retracted under the rotor 3 and clears the interface 37. In order to perform this operation of the engagement of the shoe 144 in the opening 148 well, it is essential that the key have no magnet for decoding the magnet 145, otherwise the shoe 144 will not pivot in the direction of arrow 149 and it will therefore be unable to lock the rotor to the stator in the opening 148 at the moment of withdrawing the key 101.

In its locking in the "confidential" position, at least the fastening tumbler 121 had to pivot in order to release the key 101 at the moment of disengagement of the pin 127 from the orifice 10. On the other hand, all or some of the other tumblers 21 and 121 are inoperative or in the keying position, the essential condition being that these tumblers be decoded upon the next fastening of the magnetic key by the tumbler 121 and no longer constitute an obstacle to the rotation and to the return of the rotor toward the front end of the barrel.

In the position in which the rotor is locked in its confidential position, a tumbler 221 was therefore able to pivot into an opening 226 which is not its own opening in the "ordinary" position of the barrel and likewise a tumbler 21 was able to pivot into another opening 26.

In order to be perfectly sensitive to the positions the rotor must occupy in rotation relative to the stator when it is urged into the latter, the lantern 78 of the rotor has at least one recess 58, and preferably a transverse ring arrangement of eight recesses 58 evenly spaced apart on the periphery of the lantern. These recesses 58 are formed in front of the recesses 28 at a distance equal to the depth to which the rotor can be urged relative to the stator, so that the pin 29 automatically cooperates with one of the recesses 58 at this depth. The pressure exerted by the spring 30 on the pin 29 is sufficient to ensure that the pin enters a recess 58 and thus renders the operator sensitive to the ideal rotational position the rotor must occupy inside the stator, which position selected in rotation corresponds for example to the position in whch the operator can actuate an electric switch or render the rotor inaccessible to the holder of an ordinary key by engaging the shoe 144 against the front wall 151 of the opening 148.

It must be understood that the invention is not intended to be limited to the aforementioned forms of application or embodiments. Various modifications may be envisaged without departing from the scope of the present invention. Thus, a magnetic device may be envisaged in which the fastening of the key to the rotor is achieved by means of two pivots 127 cooperating with two orifices 10. This double fastening provides the additional possibility of rendering the magnetic keys more singular. Further, a device may be envisaged which has three or more than three different positions as concerns penetration of the rotor. For this purpose, it is sufficient to employ other keys of the type 101 in which the inner end 102 of the tube 103 is closer to the end of the latter. Such keys will permit urging the rotor still further into the stator compared with the basic key 101 having a double reference position, when the new keys 101 bear by the base of their ear against the face 18 of the body of the cylinder. The barrels associated with such keys will then include two or more than two shoes 144 if it is of utility to provide two different positions of penetration of the rotor for fastening the rotor in the stator. Likewise, they will include a third and even a fourth transverse ring arrangement of recesses in the lantern 78 so as to locate a rotational position of the rotor in which it is known that some of its longitudinal and/or transverse tumblers or at least one of its shoes 144 can pivotally engage in an opening of the stator.

I claim:

1. A locking, checking, and actuating device operated by a ferromagnetic lock and comprising a magnetic key having a stem and a barrel including a rotor, a stator, and locking, checking, or actuating means disposed at the rear of said barrel and positioned relative to said stator;

said rotor comprising a hollow cylindrical sleeve having a longitudinal sleeve axis, said sleeve having an inside wall and an outside wall, said outside wall having at least one elongate tumbler placed therein, said tumbler having a transverse axis substantially at the middle thereof and being mounted for pivotable movement about said transverse axis between a first position in which said tumbler spans the interface between said rotor and said stator and prevents displacement of said rotor relative to said stator and a second position in which said tumbler clears the interface and allows the free rotation of said rotor inside said stator, said tumbler having a magnet at one end thereof and being devoid of a magnet at the other end thereof, and said rotor including means for fastening said key thereto and means for unfastening said key therefrom and a cylindrical ferrous core in the center of said rotor extending longitudinally along said sleeve axis throughout the length of said sleeve and spaced from said inside wall of said sleeve a distance slightly greater than the thickness of said stem of said key, said central ferrous core exerting a permanent force of attraction on said magnet in said tumbler; said stem of said key comprising a hollow cylindrical tube having at least one magnet embedded in the periphery thereof corresponding to said at least one tumbler, said magnet in said stem cooperating by repulsion with said magnet in said corresponding tumbler, whereby when said key is fastened, said magnet in said stem cooperates with said magnet in said corresponding tumbler, moving said tumbler from said first position to said second position, thereby allowing free rotation of said rotor in said stator, said rotation operating said locking, checking, or actuating means; and said stator surrounding said rotor and being provided with at least one opening corresponding to said at least one tumbler, said opening being positioned and configured to receive said end of said tumbler which is devoid of a magnet as long as said magnet of said key does not act on said magnet of said tumbler by repulsion to the extent of overcoming the permanent force of attraction that said central ferrous core exerts on said magnet in said tumbler.

2. The device of claim 1, at least one said tumbler being longitudinal and having a parallel-sided shape including an upper face and a lower face and being disposed in a cavity in said outside wall of said sleeve, said cavity having two opposed longitudinal edges, and said tumbler being pivotably mounted about a pin extending in a direction perpendicular to said longitudinal sleeve axis and parallel to the bottom of said cavity, between said longitudinal edges thereof, said lower face at said end of said tumbler including said magnet being bevelled in the longitudinal direction from the middle of said tumbler to said end.

3. The device of claim 1, at least one said tumbler being transverse and having the shape of a sector of a cylinder including an upper face and a lower face and being disposed in a cavity in said outside wall of said sleeve, said tumbler being pivotably mounted about a pin extending in a direction parallel to said longitudinal sleeve axis, said lower face at said end of said tumbler including said magnet being bevelled from the middle of said tumbler to said end.

4. The device of claim 2, at least one said tumbler being transverse and having the shape of a sector of a cylinder including an upper face and a lower face and being disposed in a cavity in said outside wall of said sleeve, said tumbler being pivotably mounted about a pin extending in a direction parallel to said longitudinal sleeve axis, said lower face at said end of said tumbler including said magnet being bevelled from the middle of said tumbler to said end.

5. The device of claim 1, the outer front end of said sleeve having a cavity therein, said means for fastening said key to said rotor comprising mechanical means, said stem of said key having an ear having a base, said stem having a tooth close to said base of said ear extending radially outwardly, and said tooth being cooperable with said cavity.

6. The device of claim 1, said tumbler having an upper face and a lower face and being disposed in a cavity in an outside wall of said sleeve, said inside wall of said sleeve and said central ferrous core defining an annular chamber, said means for fastening said key to said rotor comprising magnetic means, said stem of said key being provided with at least one transverse blind orifice and at least one said tumbler being provided with a radial pin extending from said lower face thereof towards said central ferrous core in said end of said tumbler devoid of a magnet, said pin extending through the entire thickness of said sleeve from the bottom of said cavity and projecting into said annular chamber, whereby said pin engages said orifice and drives said rotor whenever said key is shifted.

7. The device of claim 1, the front part of said central ferrous core extending beyond the front end of said sleeve and being flush with the outer face of said stator.

8. The device of claim 1, said key further including a protective stainless steel sheath covering the part of said stem of said key in which said magnet is embedded, said sheath being fixed in position at the end of said key.

9. The device of claim 1, said stem having at least one radially oriented cup therein corresponding to said at least one magnet in said stem, said magnet in said stem being placed in said corresponding cup.

10. The device of claim 1, the front end of said central ferrous core having a transverse groove and said stem of said key having an ear having a base, said barrel further comprising a sealing O-ring received in said transverse groove of said central ferrous core for urging back any dirt which soils the inner surface of said stem.

11. The device of claim 1, said inside wall of said sleeve and said central ferrous core defining an annular chamber, said barrel having connected thereto a rubber diaphragm closing the front part of said annular chamber and gripping round said central ferrous core whereby said lock is rendered fluidtight, said diaphragm being capable of retracting upon the passage of said key.

12. The device of claim 1, said stem of said key having an ear having a base and said key having a single reference position of abutment by said base of said ear.

13. The device of claim 1, said barrel further comprising a return spring disposed behind said rotor against the inner end of said sleeve, and said stem of said key having an ear having a base and said key having a double reference position of abutment, said double reference position comprising an ordinary position by the inner end of said cylindrical tube of said key which bears against the front of said central ferrous core and a confidential position by and rearwardly offset relative to said base of said ear, the passage from said ordinary position to said confidential position being achieved by exerting greater force when inserting said key in said lock so as to urge back said rotor in opposition to said return spring and cause said rotor to assume a second reference position which can only be decoded by means of said key having a double reference position.

14. The device of claim 1, said rotor having a plurality of tumblers, said stator being provided with a plurality of openings cooperable with at least one of said tumblers, said openings defining n positions of selection in respect of rotation of said rotor which are equally spaced apart on the periphery of said stator and in which said rotor is locked relative to said stator while allowing the unlocking of said key.

15. The device of claim 13, said rotor having a plurality of tumblers, said stator being provided with a plurality of openings cooperable with at least one of said tumblers, said openings defining n positions of selection in respect of rotation of said rotor which are equally spaced apart on the periphery of said stator and in which said rotor is locked relative to said stator while allowing the unlocking of said key.

16. The device of claim 14, wherein at least one of the front face of said sleeve, the front face of said central ferrous core, and the front face of said stator is provided with visual means for locating the selected position of said rotor relative to said stator in respect of rotation of said rotor and thereby the position in which said key must be inserted in said lock.

17. The device of claim 15, said rotor having a plurality of tumblers, said stator being provided with a plurality of openings cooperable with at least one of said tumblers, and said openings defining n positions of selection, at least two of said positions being at simultaneously different extents of penetration and extents of rotation.

18. The device of claim 1, said rotor comprising at least one shoe for selecting between a forward direction and a reverse direction of rotation of said rotor in said stator, said shoe comprising a parallel-sided tumbler having opposed front and rear parts and opposed upper and lower faces, said rear part having a magnet disposed therein, said upper face of said front part having a facet inclined forwardly and from the periphery toward the center of said rotor, said facet extending substantially over the left side of said upper face of said front part, and said key being of the type permitting a selection in respect of rotation, said key including magnets in the required number and position for producing the repulsion of all said tumblers and said shoes of said rotor.

19. The device of claim 1, said rotor comprising at least one shoe for selecting between a forward direction and a reverse direction of rotation of said rotor in said stator, said shoe comprising a parallel-sided tumbler having opposed front and rear parts and opposed upper and lower faces, said rear part having a magnet disposed therein, said upper face of said front part having a facet inclined forwardly and from the periphery toward the center of said rotor, said facet extending substantially over the right side of said upper face of said front part, and said key being of the type permitting a selection in respect of rotation, said key including magnets in the required number and position for producing the repulsion of all said tumblers and said shoes of said rotor.

20. The device of claim 1, said rotor comprising at least one shoe for selecting between a forward direction and a reverse direction of rotation of said rotor in said stator, said shoe comprising a parallel-sided tumbler having opposed front and rear parts and opposed upper and lower faces, said rear part having a magnet disposed therein, said upper face of said front part having a facet inclined forwardly and from the periphery toward the center of said rotor, said facet extending substantially over the left side of said upper face of said front part, and said key being of the type permitting a single one of two rotations of said rotor, said key being devoid of a magnet in the region of said magnet of said shoe.

21. The device of claim 1, said rotor comprising at least one shoe for selecting between a forward direction and a reverse direction of rotation of said rotor in said stator, said shoe comprising a parallel-sided tumbler having opposed front and rear parts and opposed upper and lower faces, said rear part having a magnet disposed therein, said upper face of said front part having a facet inclined forwardly and from the periphery toward the center of said rotor, said facet extending substantially over the right side of said upper face of said front part, and said key being of the type permitting a single one of the two rotations of said rotor, said key being devoid of a magnet in the region of said magnet of said shoe.

22. The device of claim 13, at least one said key having at least ordinary and confidential positions of abutment, said rotor including at least one shoe comprising a parallel-sided tumbler having opposed front and rear parts and opposed upper and lower faces, said shoe having a magnet disposed in said rear part thereof, said upper face of said front part having left and right facets inclinded forwardly and from the periphery toward the center of said rotor, said left and right facets each extending substantially over the left and right sides, respectively, of said upper face of said front part of said shoe, said stator including an opening exclusively for receiving said front part of said shoe, said shoe being pivoted when said rotor is shifted toward the rear of said stator by exerting greater force when inserting said key in said lock, thereby leaving said ordinary position and assuming said confidential position, and said key having a double reference position of abutment and being devoid of a magnet in the region of said magnet of said shoe, whereby said magnet of said shoe is permanently naturally attracted by said central ferrous core and automatically places itself in a position for keying said rotor in said stator.

23. The device of claim 14, at least one said key having at least ordinary and confidential positions of abutment, said rotor including at least one shoe comprising a parallel-sided tumbler having opposed front and rear parts and opposed upper and lower faces, said shoe having a magnet disposed in said rear part thereof, said upper face of said front part having left and right facets inclined forwardly and from the periphery toward the center of said rotor, said left and right facets each extending substantially over the left and right sides, respectively, of said upper face of said front part of said shoe, said stator including an opening exclusively for receiving said front part of said shoe, said shoe being pivoted when said rotor is shifted toward the rear of said stator by exerting greater force when inserting said key in said lock, thereby leaving said ordinary position and assuming said confidential position, and said key having a double reference position of abutment and being devoid of a magnet in the region of said magnet of said shoe, whereby said magnet of said shoe is permanently naturally attracted by said central ferrous core and automatically places itself in a position for keying said rotor in said stator.

24. The device of claim 18, at least one said key having at least ordinary and confidential positions of abutment, said rotor including at least one shoe comprising a parallel-sided tumbler having opposed front and rear parts and opposed upper and lower faces, said shoe having a magnet disposed in said rear part thereof, said upper face of said front part having left and right facets inclined forwardly and from the periphery toward the center of said rotor, said left and right facets each extending substantially over the left and right sides, respectively, of said upper face of said front part of said shoe, said stator including an opening exclusively for receiving said front part of said shoe, said shoe being pivoted when said rotor is shifted toward the rear of said stator by exerting greater force when inserting said key in said lock, thereby leaving said ordinary position and assuming said confidential position, and said key having a double reference position of abutment and being devoid of a magnet in the region of said magnet of said shoe, whereby said magnet of said shoe is permanently naturally attracted by said central ferrous core and automatically places itself in a position for keying said rotor in said stator.

25. The device of claim 19, at least one said key having at least ordinary and confidential positions of abutment, said rotor including at least one shoe comprising a parallel-sided tumbler having opposed front and rear parts and opposed upper and lower faces, said shoe having a magnet disposed in said rear part thereof, said upper face of said front part having left and right facets inclined forwardly and from the periphery toward the center of said rotor, said left and right facets each extending substantially over the left and right sides, respectively, of said upper face of said front part of said shoe, said stator including an opening exclusively for receiving said front part of said shoe, said shoe being pivoted when said rotor is shifted toward the rear of said stator by exerting greater force when inserting said key in said lock, thereby leaving said ordinary position and assuming said confidential position, and said key having a double reference position of abutment and being devoid of a magnet in the region of said magnet of said shoe, whereby said magnet of said shoe is permanently naturally attracted by said central ferrous core and automatically places itself in a position for keying said rotor in said stator.

26. The device of claim 20, at least one said key having at least ordinary and confidential positions of abutment, said rotor including at least one shoe comprising a parallel-sided tumbler having opposed front and rear parts and opposed upper and lower faces, said shoe having a magnet disposed in said rear part thereof, said upper face of said front part having left and right facets inclined forwardly and from the periphery toward the center of said rotor, said left and right facets each extending substantially over the left and right sides, respectively, of said upper face of said front part of said shoe, said stator including an opening exclusively for receiving said front part of said shoe, said shoe being pivoted when said rotor is shifted toward the rear of said stator by exerting greater force when inserting said key in said lock, thereby leaving said ordinary position and assuming said confidential position, and said key having a double reference position of abutment and being devoid of a magnet in the region of said magnet of said shoe, whereby said magnet of said shoe is permanently naturally attracted by said central ferrous core and automatically places itself in a position for keying said rotor in said stator.

27. The device of claim 21, at least one said key having at least ordinary and confidential positions of abutment, said rotor including at least one shoe comprising a parallel-sided tumbler having opposed front and rear parts and opposed upper and lower faces, said shoe having a magnet disposed in said rear part thereof, said upper face of said front part having left and right facets inclined forwardly and from the periphery toward the center of said rotor, said left and right facets each extending substantially over the left and right sides, respectively, of said upper face of said front part of said shoe, said stator including an opening exclusively for receiving said front part of said shoe, said shoe being pivoted when said rotor is shifted toward the rear of said stator by exerting greater force when inserting said key in said lock, thereby leaving said ordinary position and assuming said confidential position, and said key having a double reference position of abutment and being devoid of a magnet in the region of said magnet of said shoe, whereby said magnet of said shoe is permanently naturally attracted by said central ferrous core and automatically places itself in a position for keying said rotor in said stator.

28. The device of claim 1, said means for unlocking said key comprising a ball extending through said stator and resiliently yieldable means for permanently biassing said ball toward said rotor beyond the interface of said rotor and said stator, the rear of said outside wall of said rotor being provided with at least one recess, and said ball being cooperative with said at least one recess.

29. The device of claim 1, said means for unlocking said key comprising a pin extending through said stator and resiliently yieldable means for permanently biassing said pin toward said rotor beyond the interface of said rotor and said stator, the rear of said outside wall of said rotor being provided with at least one recess, and said pin being cooperative with said at least one recess.

30. The device of claim 28, the rear and periphery of said sleeve of said rotor comprising a plurality of recesses arranged in a transverse ring and evenly spaced apart in accordance with said openings in said stator and said tumblers in said rotor, said recesses defining n positions of selection of said rotor in respect of rotation of said rotor.

31. The device of claim 29, the rear and periphery of said sleeve of said rotor comprising a plurality of recesses arranged in a transverse ring and evenly spaced apart in accordance with said openings in said stator and said tumblers in said rotor, said recesses defining n positions of selection of said rotor in respect of rotation of said rotor.

32. The device of claim 28, said key having ordinary and confidential reference positions of abutment, said rotor having a front face and including a plurality of recesses, and at least two of said recesses being at different distances from said front face of said rotor, whereby said at least two recesses act as an index for locking said rotor.

33. The device of claim 29, said key having ordinary and confidential reference positions of abutment, said rotor having a front face and including a plurality of recesses, and at least two of said recesses being at different distances from said front face of said rotor, whereby said at least two recesses act as an index for locking said rotor.

34. The device of claim 30, said key having ordinary and confidential reference positions of abutment, said rotor having a front face and including a plurality of recesses, and at least two of said recesses being at different distances from said front face of said rotor, whereby said at least two recesses act as an index for locking said rotor.

35. The device of claim 31, said key having ordinary and confidential reference positions of abutment, said rotor having a front face and including a pluarality of recesses, and at least two of said recesses being at different distances from said front face of said rotor, whereby said at least two recesses act as an index for locking said rotor.

36. The device of claim 1, said stem of said key comprising a cylindrical tube, said magnet being embedded therein.

37. The device of claim 15, wherein at least one of the front face of said sleeve, the front face of said central ferrous core, and the front face of said stator is provided with visual means for locating the selected position of said rotor relative to said stator in respect of rotation of said rotor and thereby the position in which said key must be inserted in said lock.

* * * * *